United States Patent [19]

Kruszecki

[11] 4,082,401

[45] Apr. 4, 1978

[54] BATTERY CABLE CONNECTOR

[76] Inventor: Steve Kruszecki, Jefferson St., P.O. Box 30055, Chicago, Ill. 60630

[21] Appl. No.: 725,022

[22] Filed: Sep. 20, 1976

[51] Int. Cl.[2] ..... H01R 11/20

[52] U.S. Cl. ..... 339/95 B; 339/224

[58] Field of Search ..... 339/32, 33, 95 R, 95 A, 339/95 B, 224–240, 276, 28, 29

[56] References Cited

U.S. PATENT DOCUMENTS

| | | | |
|---|---|---|---|
| 1,614,880 | 1/1927 | Collins | 339/95 B |
| 1,687,574 | 10/1928 | Liss | 339/276 T |
| 1,690,118 | 11/1928 | Julyan | 339/29 B |
| 1,779,756 | 10/1930 | Stone | 339/228 |
| 2,399,836 | 5/1946 | Taylor | 339/276 T |
| 2,547,932 | 4/1951 | Downs, Jr. | 339/95 B |

FOREIGN PATENT DOCUMENTS

| | | | |
|---|---|---|---|
| 248,443 | 5/1963 | Australia | 339/225 |

*Primary Examiner*—Joseph H. McGlynn
*Attorney, Agent, or Firm*—Paul H. Gallagher

[57] ABSTRACT

A connector for a booster cable as usually used in connection with automobiles, having a main plate and a clamping plate pivoted thereon. The plates have cooperating notches receiving a top post of the battery, the clamping plate being drawn up tight, with the edges of the notches gripping the post. The plates of the connector fit under the usual clamp on the cable which forms a part of the permanent electrical circuit of the automobile, and that clamp need not be removed to apply the present cable. The main plate also has additional notches for mounting on the binding posts that are provided on the sides of certain batteries, instead of on the top, the main plate in this case being secured in place by a nut provided on the battery and otherwise utilized for securing cables in the permanent electrical circuit.

7 Claims, 9 Drawing Figures

BATTERY CABLE CONNECTOR

FIELD OF THE INVENTION

The invention is directed to automobiles, and particularly to a cable that is ordinarily used in connection with a disabled battery in an automobile. The cable is used for example for connecting a booster battery with the disabled battery. Automobile batteries usually have posts on the top, extending upwardly, and secured to these posts are clamps on cables that are part of the permanent electrical circuit of the automobile. In the use of a booster cable of the kinds in use heretofore, it has been difficult to make good connection with the battery in the automobile, generally because it was always necessary to make connection with those clamps, and the overall purpose of the present invention is to overcome difficulties of such character.

OBJECTS OF THE INVENTION

A broad object of the invention is to provide a new booster cable adapted particularly for use in connection with a disabled automobile battery and specifically having novel connector means for establishing secure and tight connection with the posts of the battery.

A more specific object is to provide a cable of the general kind mentioned which is particularly adapted to use where permanent clamps are already on the battery to be boosted, and is arranged for making direct contact with the post of the battery notwithstanding the presence of such clamps, and not in any way interfering with the tight securement of those clamps.

Still another object is to provide a connector of the foregoing kind that is made up of plate elements relatively movably and operatively secured together, that together form a very thin connector that can be fitted in the small space that usually exists between the clamp referred to and the surface of the battery.

Still another object is to provide such a battery cable connector of the character just referred to, that grips tightly into the surface of the binding post.

Still another object is to provide a new battery cable connector for use in connection with automobile batteries that accommodates what are now standard batteries having binding posts on the top of relatively greater diameter, and also accommodates more modern batteries having terminal posts on the side which are of relatively smaller diameter and onto which cable clamps are secured by nuts, with the result that the connector is more versatile and flexible in use.

DESCRIPTION OF A PREFERRED EMBODIMENT

Figure 1:
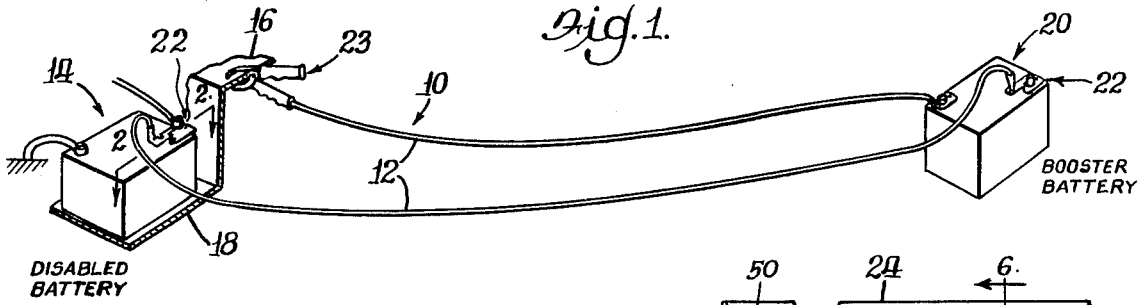
FIG. 1 is a semi-diagrammatic view of a booster cable having connectors embodying the present invention in association with a disabled battery in an automobile, and a fragment of the frame of the automobile, and a booster battery.

Referring in detail to the accompanying drawings, a booster cable made according to the present invention is indicated generally at 10 having two individual cable elements 12. A battery to be started, or a disabled battery, is indicated at 14 which is an automobile here represented by a fragment of the frame 16, the numeral 18 indicating a shelf or holder supporting the battery. A booster battery is shown at 20, for starting the disabled battery.

The cable means 10 includes a plurality of connectors 22 embodying the present invention, these connectors being three in number in the present instance, and further includes a gripper type connector 23 which is a commonly known kind, utilized for merely gripping an element of the frame of the automobile instead of a binding post as will be referred to again hereinbelow.

A connector 22 is shown in detail in FIGS. 2–5. The connector is preferably of stainless steel, non-corrosive, of good electrical conductivity and wearing qualities. The connector includes a main plate 24 which is of suitable dimensions. The main plate 24 has a main notch 26 for receiving the binding post 27 which is of relatively greater diameter and of the type usually provided on standard automobile batteries, being on the top and extending upwardly. Mounted on the main plate 24 is a clamping plate or supplementary plate 28, pivoted as by a rivet 30. The clamping plate 28 also includes a notch 32 similar in size to the notch 26, and is swingable between an open position shown in FIG. 3 and a closed position shown in FIG. 2. The plates are preferably of thin sheet material.

Figure 2:
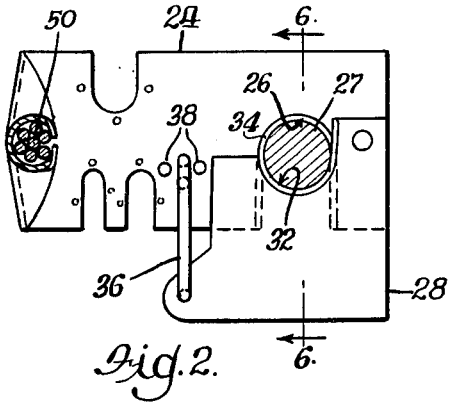
FIG. 2 is a relatively large scale view of the connector itself taken approximately at line 2—2 of FIG. 1, this figure showing the connector in closed or clamped position about a battery terminal or post.
Figure 3:
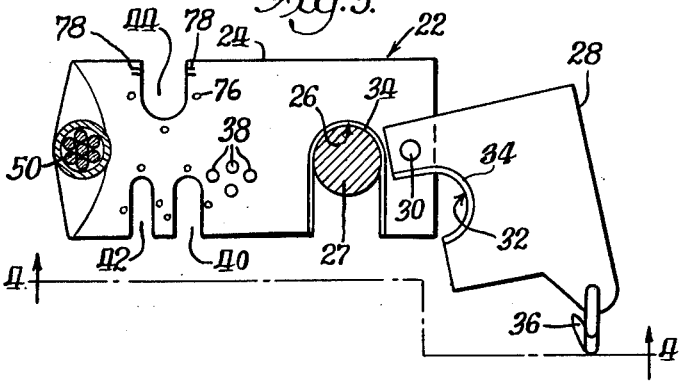
FIG. 3 is a view similar to FIG. 2 but showing the connector in unclamped or open position.
Figure 6:
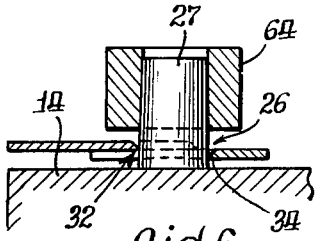
FIG. 6 is a view taken at line 6—6 of FIG. 2.

In applying the connector to a binding post, it is fitted with the post in the notch 26, and then the clamping plate 28 is swung to closed position, FIG. 2, in which the notch 32 is fitted to the post, and the two notches together form a circle enclosing the binding post as shown. The edges of the notches 26, 32, particularly the inner arcuate portions thereof, are extremely sharp as shown at 34 in FIG. 6 and when in position on the binding post, as referred to again hereinbelow, they securely engage the post, penetrating any surface coating that might otherwise tend to obstruct good electrical contact.

The clamping plate 28 is provided with a swivel hook 36 which may be hooked into one of a series of apertures 38 in the main plate 24 when the clamping plate is swung to closed position, for securing the clamping plate in such position, the apertures 38 being different distances from the corresponding edge of the main plate, along the line of movement of the clamping plate in closing direction, for drawing the clamping plate up tight and assuring tight gripping engagement with the post.

Figure 7:
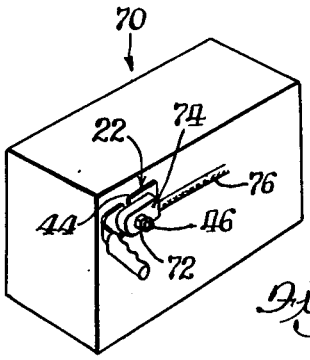
FIG. 7 is a perspective view of a battery having a binding post on the side, which is of relatively smaller diameter, with the connector of the present invention secured thereto.
Figure 8:
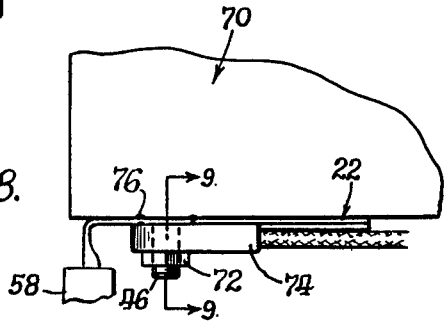
FIG. 8 is a fragmentary view from the top of FIG. 7.

The main plate 24 is also provided with secondary notches 40, 42, 44 in the side edges, these notches being utilized in fitting the connector to a binding post 46 as shown in FIGS. 7 and 8 and referred to again hereinbelow.

Figure 5:
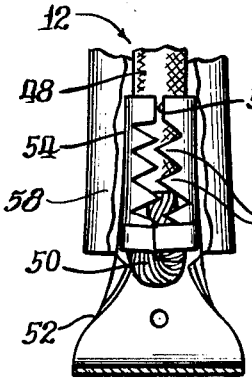
FIG. 5 is a view taken at line 5—5 of FIG. 4.

The connector proper 22 is secured to the cable element 12 as shown best in FIGS. 2 and 5. The cable element is provided with the usual sleeve of insulation 48 and enclosed conductor strands 50. The main plate 24 at one end has an upturned portion 52 generally perpendicular to the plate element and this is formed into a sleeve 54 (FIG. 5) with a slit 55 and clamped around the cable, the sleeve having teeth 56 at the edges of the slit which individually bite into and grip the cable, some of them directly and tightly grippingly engaging the conductor strands 50. Thus a secure connection is made between the cable itself and the connector. Preferably each cable element is provided with a hand grip 58 for convenience in gripping the cable, this grip preferably normally closing the end of the cable and that portion thereof shown in FIG. 5 in which it is connected with the plate.

Figure 4:
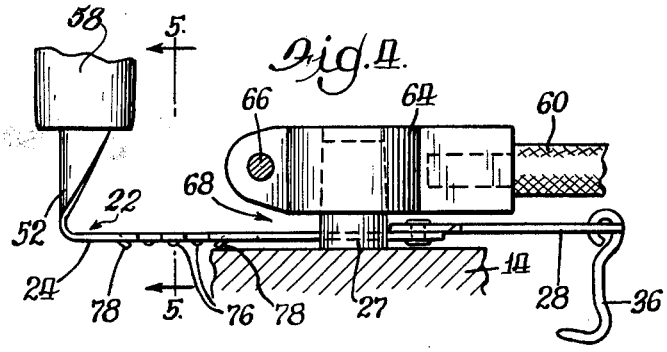
FIG. 4 is a side view oriented according to line 4—4 of FIG. 2.

The connector proper is secured to the binding post, in the one case where the binding post is on the top of the battery as represented in FIG. 4. In this figure the battery 14 is shown with the binding post 27 extending upwardly therefrom, and a cable 60 which is part of the standard permanent electrical circuit of the automobile, has a clamp connector 64 of known type. This connector is fitted on the binding post and brought into tight securement as by a clamping screw 66, there usually being a space left between the connector and the top of the battery as indicated at 68. The connector 22 being made of thin flat plates, produces a correspondingly thin total connector that readily fits into the space 68. The connector is so fitted in position, with the clamping plate 28 in open position, and after the binding post is fitted in the notch 26, the plate 28 is moved to closed position as shown in FIG. 2 and locked in that position, as referred to above. This fitting of the connector to the binding post is therefore done without in any way interfering with the normal connection of the clamp 64 to the binding post, the contact engagement between that clamp and the binding post having been established theretofore, and such connection remains unimpaired despite the application of the present connector.

Heretofore it has been difficult and many times impossible to make good contact engagement with the disabled battery by the ordinary gripper gripping into the outer surface of the clamp 64. However in the present case the connector 22 is connected directly into contact engagement with the binding post itself, under the clamp 64, and the sharp edges 34 are easily brought into contact engagement of the post, cutting through any corrosive coating that may be on the post.

As mentioned above, the cable means 10 is in this case provided with three of the type of connectors 22 embodying the present invention. The fourth connector 23 may be utilized, this connector being of well known gripper type heretofore used, similar to a pliers construction. In utilizing the booster cable, the cable is applied to the posts of the booster battery 20 by securing the corresponding connectors 22 to the posts of that battery, and in the case of the disabled battery, the cable secured to the positive post of the booster battery is provided with a connector 22 of the present invention and is secured to the positive post of the disabled battery. However the other cable, or negative, is secured to the frame 16 of the automobile at any convenient place, this connecting arrangement establishing a circuit through the disabled battery, as is known. Since the connector 23 is secured to the automobile frame, instead of the battery post, a gripper type may be utilized, that type being more convenient.

Figure 9:
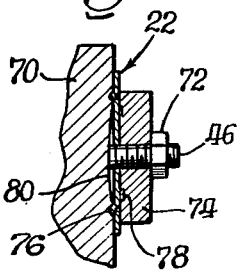
FIG. 9 is a detail view taken at line 9—9 of FIG. 8.

FIGS. 7, 8 and 9 show a battery 70 which is provided with a binding post 46 referred to above. This binding post is normally of lesser diameter than older types, such as 27, and is provided with a nut 72 threaded thereon normally securing the cable connector 74 thereon, the connector 74 merely having an open notch in its side fitted on the post, the nut 72 then being threaded up tight to secure it in place. To use the connector 22 of the present invention on the battery 70, FIGS. 7–9, the nut 72 is merely backed off partially while leaving the connector 74 on the post and then the connector 22 is fitted thereon between the connector 74 and the battery, with the binding post fitted in one of the secondary notches 40, 42, 44 and then the nut 72 is threaded up tight again. This manner of securing the connector 20 is very simple and quick, and it can be done without disturbing the connection of the connector 74 and good contact engagement is made very quickly.

Preferably the main plate 24 is provided with projections which may be in the form of embossed pimples 76 or tangs 78 struck from the surface of the plate. These are positioned in the present case on the under surface of the plate and when the connector is positioned as in FIGS. 7–9, they engage a contact portion of the battery and bite into and penetrate through any corrosive coating thereon. The pimples 76 are relatively pointed and produce the penetration mentioned, and the tangs 78 are springy, being of stainless steel, and give greater assurance of penetration. Often the battery is recessed as at 80, and the projections compensate for any tendency toward forcing the plate 24 into the recess, maintaining good contact. The projections function in the same manner as similar projections formed on the connector 74.

Thus the connector of the present invention has the advantage of quick placement on the battery, of either kind, and good and secure contact engagement is made without in any way interfering with the connector already in place, and it is versatile or flexible in use, being adapted to both kinds of batteries having the larger binding posts on the top and the smaller ones on the side.

I claim:

1. A battery cable connector, comprising, a main plate having a notch in one edge thereof, a clamping plate pivotally mounted on the main plate and also having a notch in one edge thereof, the clamping plate being swingable on the main plate between an open position in which the notch in the main plate is open and adapted to receive a binding post in position therein, and a closed position in which the notches are in register and form a closed hole surrounding a binding post so positioned, releasable interlocking means between the plates for bringing them into tight contact engagement with the binding post, the main plate having secondary open notches for selectively receiving a binding post, and adapted for securement with the binding post by nut means, and the main plate having means for connecting the connector with a cable.

2. A battery cable connector according to claim 1 in conjunction with a battery of the kind having a binding post on the top and extending upwardly therefrom and a clamp secured on the binding post with a space between the clamp and the top of the battery, the connector being positioned and confined in said space with the binding post so positioned in said notches, and the plates interlocked in mutually reacting engagement with the binding post, notwithstanding the uninterrupted connected securement of the clamp on the binding post.

3. A battery cable connector according to claim 1 wherein the main plate and the clamping plate are flat and relatively thin, each notch has an inner portion generally curved, and the two notches, when the plates are in closed position, being opposed and together forming a continuous margin defining said hole, the margin formed by said inner portions of the notches being in the form of sharp edges, and the two together forming a continuous circular sharp edge surrounding the binding post, and the interlocking means is capable of relatively drawing the plates together to cause the sharp edges to penetrate through any corrosive coating on the binding post at all positions around the binding post.

4. A battery cable connector according to claim 1 wherein the interlocking means includes a plurality of apertures in the main plate and a hook mounted on the clamping plate releasably insertable into the apertures, the apertures being spaced along the direction of movement of the clamping plate in closing direction whereby to quick-releasably lock the plates in tight engagement with binding posts of different sizes.

5. A battery cable connector according to claim 1 in conjunction with a cable having a sleeve of insulation and conductor strands therein with portions exposed beyond the insulation at an end of the cable, the connector including a sleeve element integral with the main plate and having a longitudinal split with interfacing teeth on opposite edges of the split, a portion of the teeth being clinched into the insulation for forming a mechanical connection, and a portion into the conductor strands for forming electrical contact engagement.

6. A battery cable connector according to claim 1 wherein the main plate is provided with projections formed in and extending from the plate on at least one side of the plate adjacent at least one of said secondary notches, the main plate being adapted to be operatively connected with a post with the post received in said one secondary notch and the main plate clamped between a pair of members, whereby the projections penetrate through corrosive coating on the corresponding one of the members which they engage and thereof establish good electrical contact engagement therewith.

7. A battery cable connector according to claim 6 in conjunction with a battery of the kind having a binding post on the side with a permanent connector releasably secured thereon by nut means and constituting one of said pair of members, the present connector being fitted on the binding post with the latter received in said one secondary notch, and the nut turned up tight and tightly gripping the present connector between said pair of members in firm contact engagement therewith.

* * * * *